US006349431B1

(12) United States Patent
Meade et al.

(10) Patent No.: US 6,349,431 B1
(45) Date of Patent: Feb. 26, 2002

(54) CONVERTIBLE FURNITURE FRAME

(76) Inventors: Thomas L. Meade, 274 Reese Rd., Nittany Mountain Industrial Park, State College, PA (US) 16801; Christopher O'Donnell, 649 Adams St., Delran, NJ (US) 08075

( * ) Notice: Subject to any disclaimer, the term of this patent is extended or adjusted under 35 U.S.C. 154(b) by 0 days.

(21) Appl. No.: 09/524,165

(22) Filed: Mar. 13, 2000

(51) Int. Cl.[7] ..... A47C 17/17
(52) U.S. Cl. ..... 5/37.1; 5/41; 5/48
(58) Field of Search ..... 5/37.1, 41, 47, 5/48

(56) References Cited

U.S. PATENT DOCUMENTS

| | | | | |
|---|---|---|---|---|
| 4,829,611 A | | 5/1989 | Fireman et al. | |
| 4,996,730 A | | 3/1991 | Fireman et al. | |
| 5,083,333 A | * | 1/1992 | Newton | 5/47 |
| 5,170,519 A | | 12/1992 | Meade | |
| 5,315,722 A | * | 5/1994 | Djie | 5/37.1 |
| 5,327,591 A | | 7/1994 | Fireman et al. | |
| 5,429,415 A | | 7/1995 | Meade | |
| 5,509,151 A | | 4/1996 | Fireman et al. | |
| 5,519,902 A | | 5/1996 | Meade | |
| 5,628,076 A | * | 5/1997 | Newton | 5/37.1 |
| 5,664,268 A | | 9/1997 | Stoler et al. | |
| 5,815,858 A | | 10/1998 | Dodge | |
| 5,940,907 A | * | 8/1999 | Stoler et al. | 5/37.1 |
| 5,956,785 A | | 9/1999 | Fireman | |

* cited by examiner

*Primary Examiner*—Michael F. Trettel
(74) *Attorney, Agent, or Firm*—Caesar, Rivise, Bernstein, Cohen & Pokotilow, Ltd.

(57) ABSTRACT

A furniture frame convertible from a seat to a bed is disclosed. The furniture frame includes side frame members spaced-apart by a supporting rail and a body-supporting member including two sections pivotally connected together and connected to the side frame members substantially toward the rear of the furniture frame. In the disclosed furniture frame the two sections are movable relative to each other between at least a first and second sitting orientations and a bed orientation wherein the second sitting orientation is less upright than the second sitting orientation. The two sections provide a seat section and a back section having transversely spaced apart side section members and upper surfaces inclined relative to each other when the two sections are in one of the first and second sitting orientations.

66 Claims, 10 Drawing Sheets

FIG.1
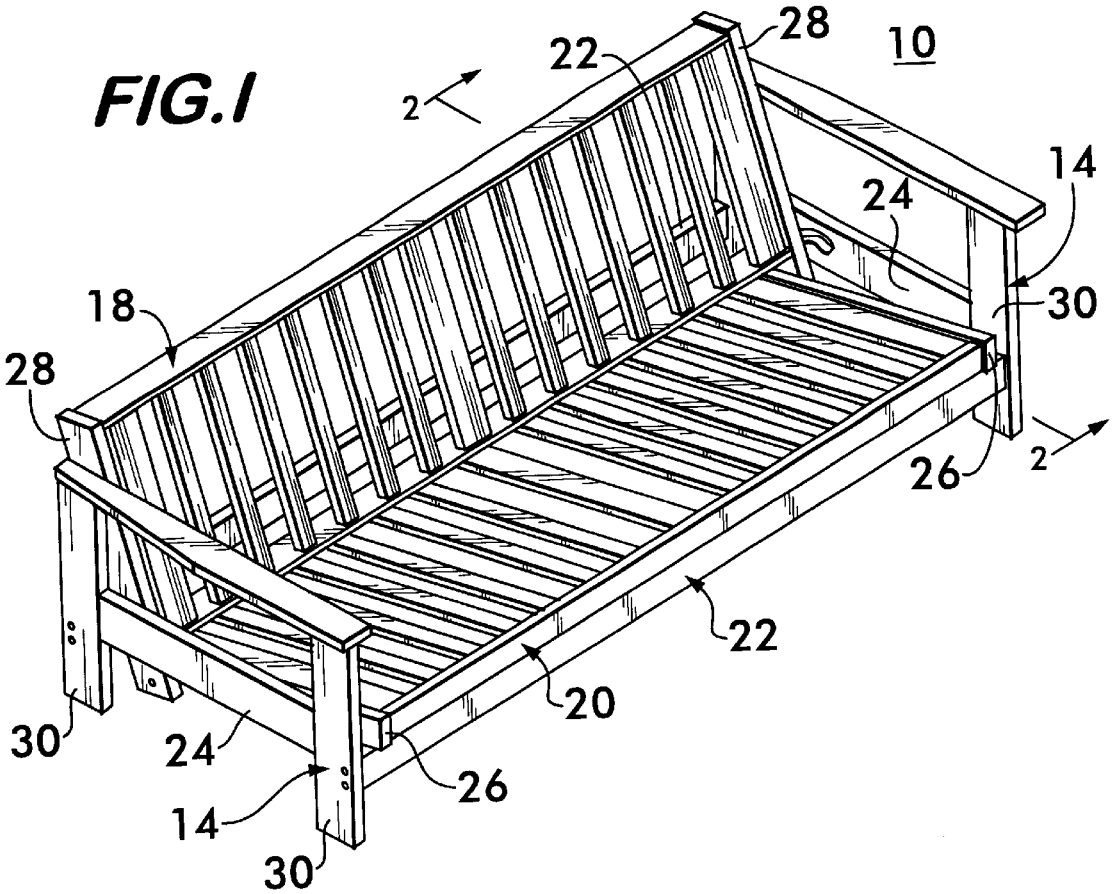
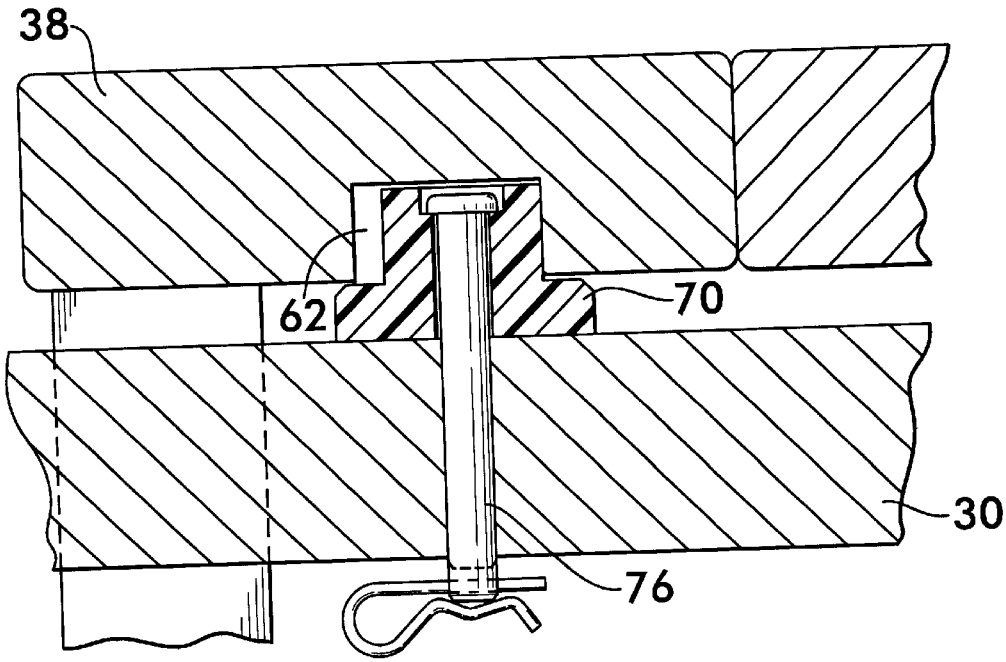
FIG.6

10
18
28
70
62
30
22
14
60a
69
50
52
66b
56
68
70
63
24
64
26
65
20
22
30

10
18
28
70
62
30
22
14
70
63
24
64
65
20
22
30
26
68
56
60b
52
50
69
60a 10
30
70
66
84
86
72
74
62
82
78
88
63
70
24
70
28

FIG.8
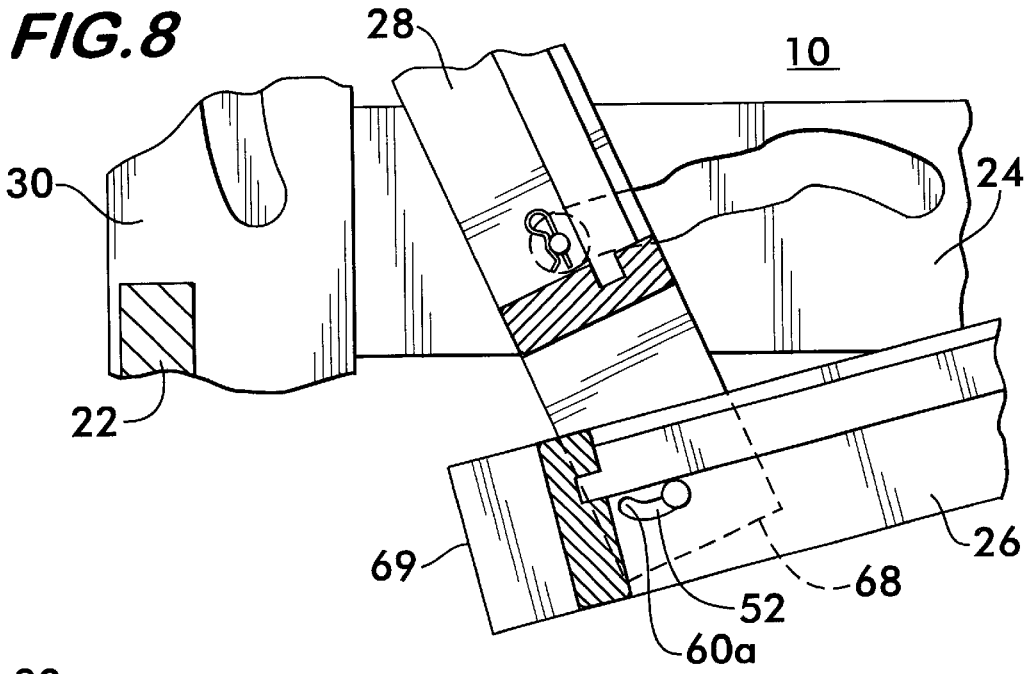
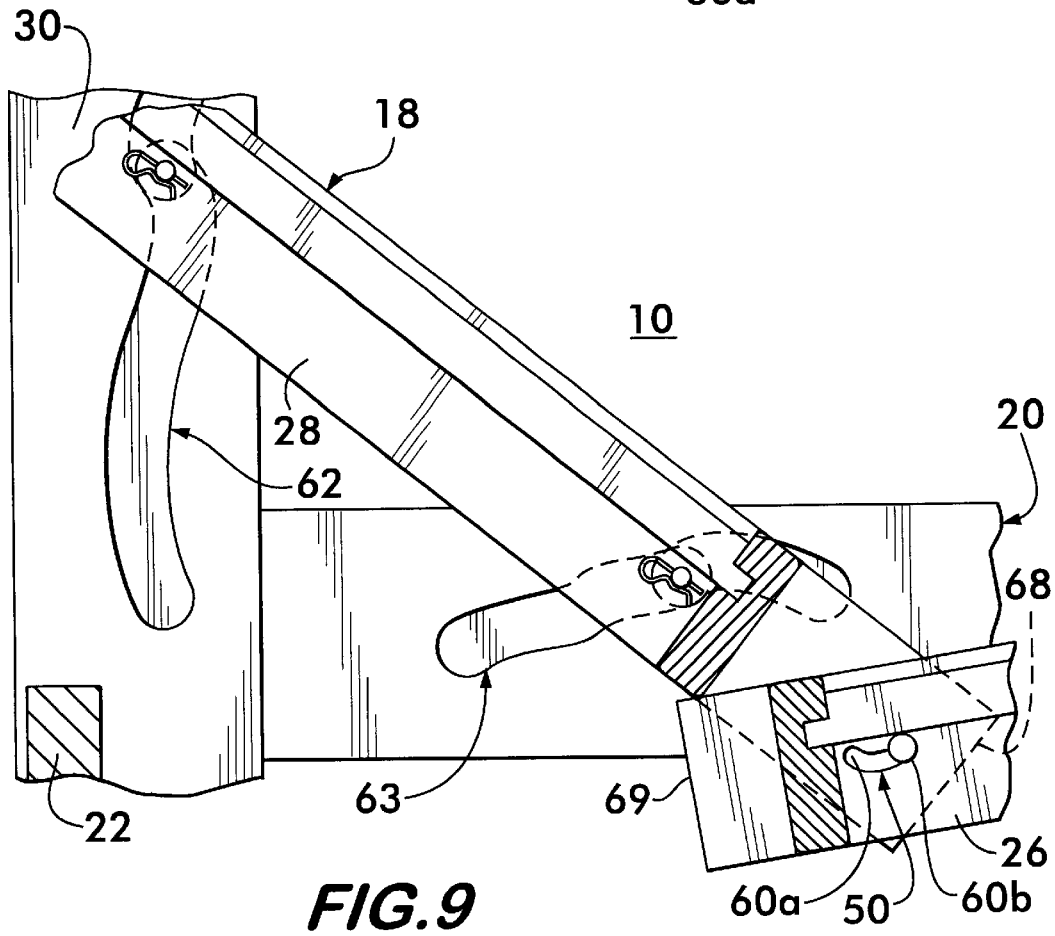
FIG.9

CONVERTIBLE FURNITURE FRAME

FIELD OF THE INVENTION

The invention relates generally to convertible furniture frames, and more specifically, to convertible furniture frames suitable for use in supporting futons in different body-supporting orientations.

BACKGROUND OF INVENTION

Furniture frames for supporting futons in multiple positions are well known in the art. For example, U.S. Pat. No. 5,664,286, issued to Stoler on Sept. 9, 1997, teaches such a furniture frame. The frame taught by Stoler is adapted to act both as a couch and a bed. It includes two pivotally attached pad support members wherein the support members have limited lateral motion along the pivot point to allow for temporary locking and unlocking of the two pad support members. This pivotal attachment enables the pad support members to be rotatably moved between the sitting and reclining positions.

The frame taught by Stoler also has arms with two slots for engaging slot followers that extend from one of the support members. As the frame is converted between the couch and bed positions, the slot followers move through the slots. It is known in the prior art of convertible furniture frames for the slot followers to be devices such as rollers. One of the two slots on each of the arms taught by Stoler is a substantially linear horizontal slot having a slot angle at one end and a small vertical component in its slope. The other slot is a substantially linear vertical slot having another slot angle at one end and a small horizontal component to its slope. When the support members are in the bed position, the slot followers dwell in the vicinity of the end of the slot having the slot angle. As the support members are moved to the upright position, the slot followers travel to the opposite ends of the slots. The pivot joining the support members is a hinge pin dwelling in a substantially linear elongate slot.

U.S. Pat. No. 5,815,858, issued to Dodge on Oct. 6, 1998, also teaches slots for guiding slot followers. The slots taught by Dodge are also formed in the arms of the furniture frame. They are sloped and substantially linear with an angle at one end of each slot. Additionally, Dodge teaches a pivot between the support members including an elongate slot for the hinge pin. One end of the elongate slot is arcuate for assisting in maintaining the support members in a locked relationship when the furniture frame is in a sitting position.

Other prior art references include U.S. Pat. Nos. 4,829,611, 4,996,730, 5,327,491, 5,509,151 and 5,956,785 issued to Robert Fireman. The Fireman references also teach convertible furniture frames, including furniture frames having arms with slots to receive and retain slot followers extending from a support member. They also teach pivots having elongate slots. Other prior art includes U.S. Pat. Nos. 5,170,519, 5,429,415 and 5,519,902 all issued to Meade. These patents generally illustrate the art of futons and convertible furniture frames for supporting futons.

SUMMARY OF THE INVENTION

A furniture frame convertible from a seat to a bed is disclosed. The furniture frame includes side frame members spaced-apart by a supporting rail and a body-supporting member including two sections pivotally connected together and connected to the side frame members substantially toward the rear of the furniture frame. In the disclosed furniture frame the two sections are movable relative to each other between at least a first and second sitting orientations and a bed orientation wherein the second sitting orientation is less upright than the second sitting orientation. The two sections provide a seat section and a back section having transversely spaced apart side section members and upper surfaces inclined relative to each other when the two sections are in one of the first and second sitting orientations. The upper surfaces of the two sections are aligned in substantially the same horizontal plane when the two sections are in the bed. A pivot connection between the two sections permits relative rotational motion of the two sections between the at least first and second sitting orientations and the bed orientation. The section members of the back section include transversely extending followers and each of the side frame members includes a pair of elongate position-locating and retaining slots, one of the followers on the side section members of the back section being disposed within one slot of the pair of retaining slots, and the other of the followers on the side section members of the back section being disposed within the other slot of the pair of retaining slots. The followers are movable within the retaining slots as the seat and back sections move from the at least first and second sitting orientations and the bed orientation. The retaining slots have a first locking location for disposing the two sections in the first sitting orientation and locking the two sections in the first sitting orientation. The retaining slots also have a second locking location for disposing the two sections in the bed orientation and locking the two sections in the bed orientation. The first locking location has a first bump therein for retaining one of the followers within the first locking location. A third sitting orientation for disposing the two sections in the third sitting location can be provided wherein the third sitting orientation is less upright than the first sitting orientation. The retaining slots can have a third locking location for disposing the two sections in the third sitting orientation and locking the two sections in the third sitting orientation. The retaining slots include horizontal retaining slots and vertical retaining slots on each of the side frame members, the horizontal retaining slots including the first and second locking locations and the vertical retaining slots having a support stop therein for supporting one of the slot followers when the two sections are disposed in the third sitting orientation. The support stop is disposed in a region of the vertical retaining slot having an angle greater than zero with respect to the vertical. A section stop can prevent relative motion between the supporting rail and the seat section wherein the section stop can be a notch formed in the seat section for mating with the supporting rail to prevent the relative motion between the supporting rail and the seat section or an abutment extending downwardly from the seat section.

DESCRIPTION OF THE DRAWINGS

FIG. 1 shows a perspective view of the convertible furniture frame of the present invention;wnwardly from FIG. 2 shows a side view of the convertible furniture frame of the present invention in the upright most orientation of the multiple sitting orientations of the invention;

FIG. 6 shows a cross-sectional representation of a slot and a slot follower for controlling the movement of the sections of the convertible furniture frame of the invention for each of the multiple sitting orientations of the invention;

FIG. 8 shows a side view of a portion of the convertible furniture frame in the most upright sitting orientation of the present invention;

FIG. 9 shows a side view of a portion of the convertible furniture frame in the least upright sitting orientation of the present invention;

DETAILED DESCRIPTION OF THE PREFERRED EMBODIMENT

Figure 2:
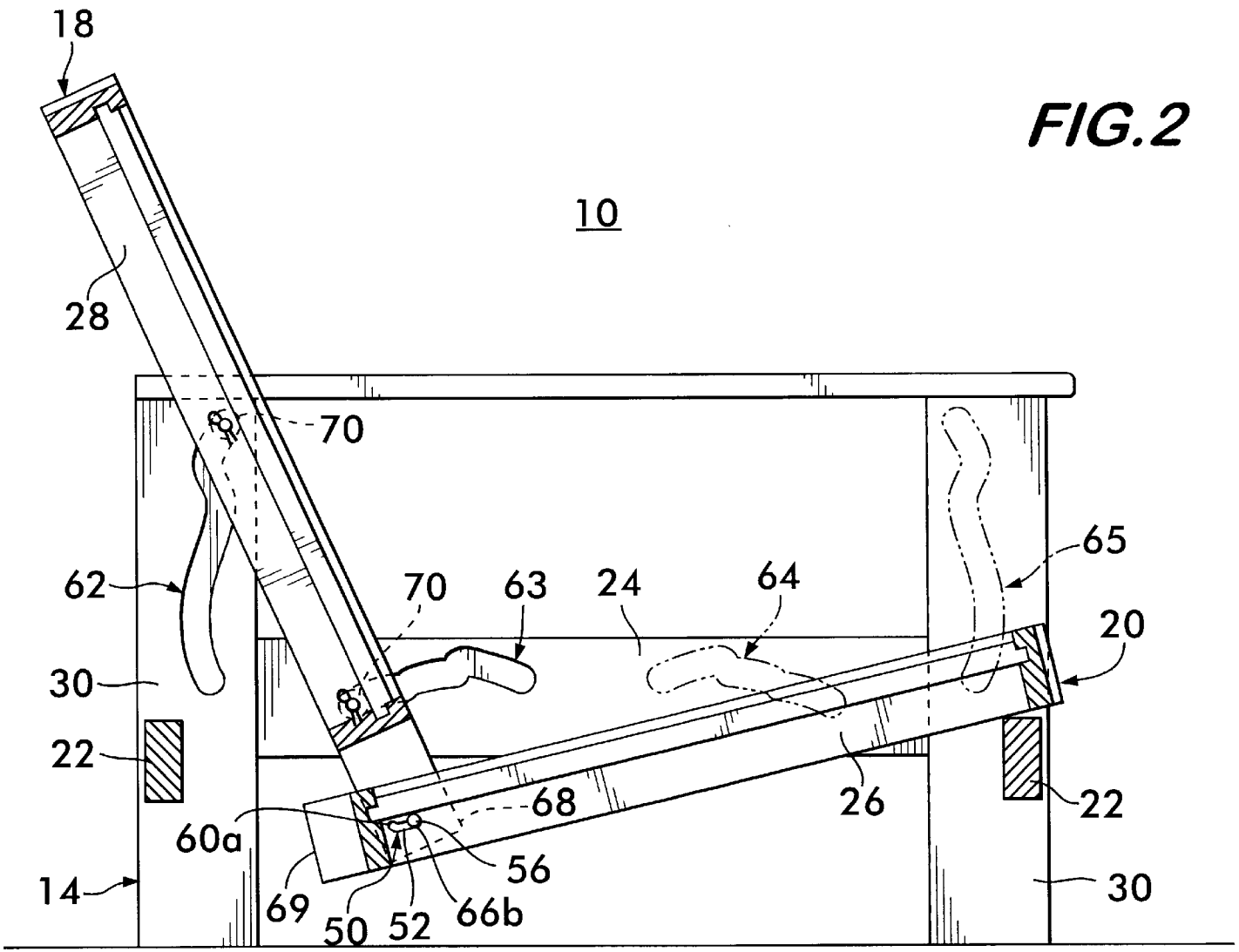

Referring now to FIG. 1, there is shown the convertible furniture frame 10 of the present invention. A body supporting member is provided within the convertible furniture frame 10 wherein the body supporting member includes two overlapping frame sections 18, 20 that are pivotally connected to each other. The two frame sections 18, 20 include a back rest frame section 18 and a seat frame section 20 that are moveable relative to each other between at least one sitting orientation and a bed orientation.

The upper surfaces of frame sections 18, 20 are inclined relative to each other when the frame sections 18, 20 are in one of the sitting orientations. The upper surfaces of the frame sections 18, 20 are aligned in substantially the same horizontal plane when the convertible furniture frame 10 is disposed in the bed orientation. In the preferred embodiment of the convertible furniture frame 10 three sitting positions are provided.

The back rest frame section 18 is formed with transversely spaced apart section side members 28. The seat frame section 20 is formed with transversely spaced apart section side members 26. The convertible furniture frame 10 is provided with transverse spaced apart side frame members 14. Side frame members 14 include vertical side sections 30 and horizontal side sections 24.

Referring to FIGS. 2–5, there are shown three sitting positions and a bed orientation of the convertible furniture frame 10 of the present invention. In order to permit relative rotational movement between the orientations of the convertible furniture frame 10, a pivot connection 50 is provided between the overlapping regions of the frame sections 18, 20 at each end of the convertible furniture frame 10. The pivot connections 50 are located toward the rear of the seat frame section 20 and toward the bottom of the back frame rest section 18.

Figure 3:
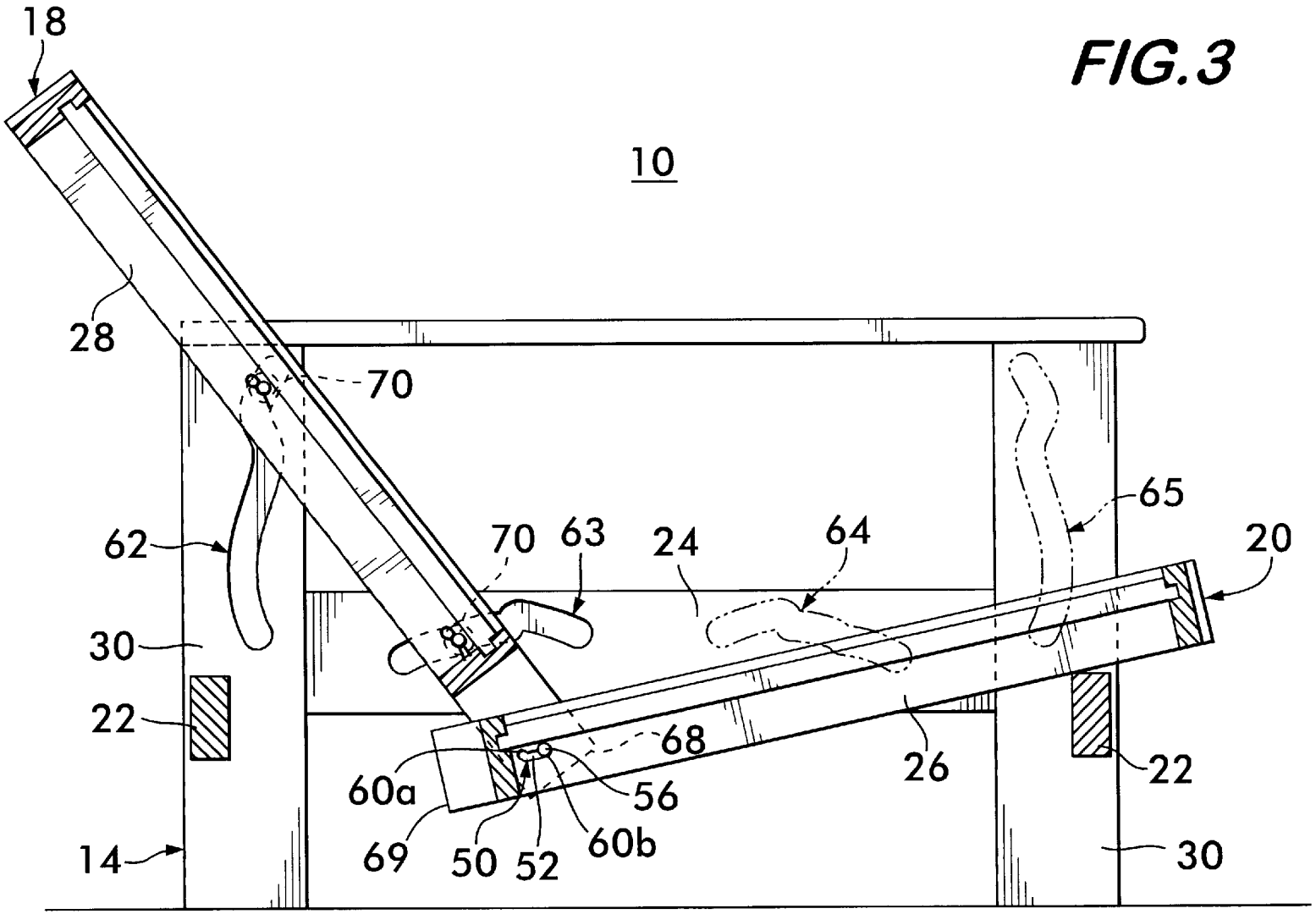
FIG. 3 shows a side view of the convertible furniture frame of the present invention in the second most upright orientation of the multiple sitting orientations of the invention.
Figure 4:
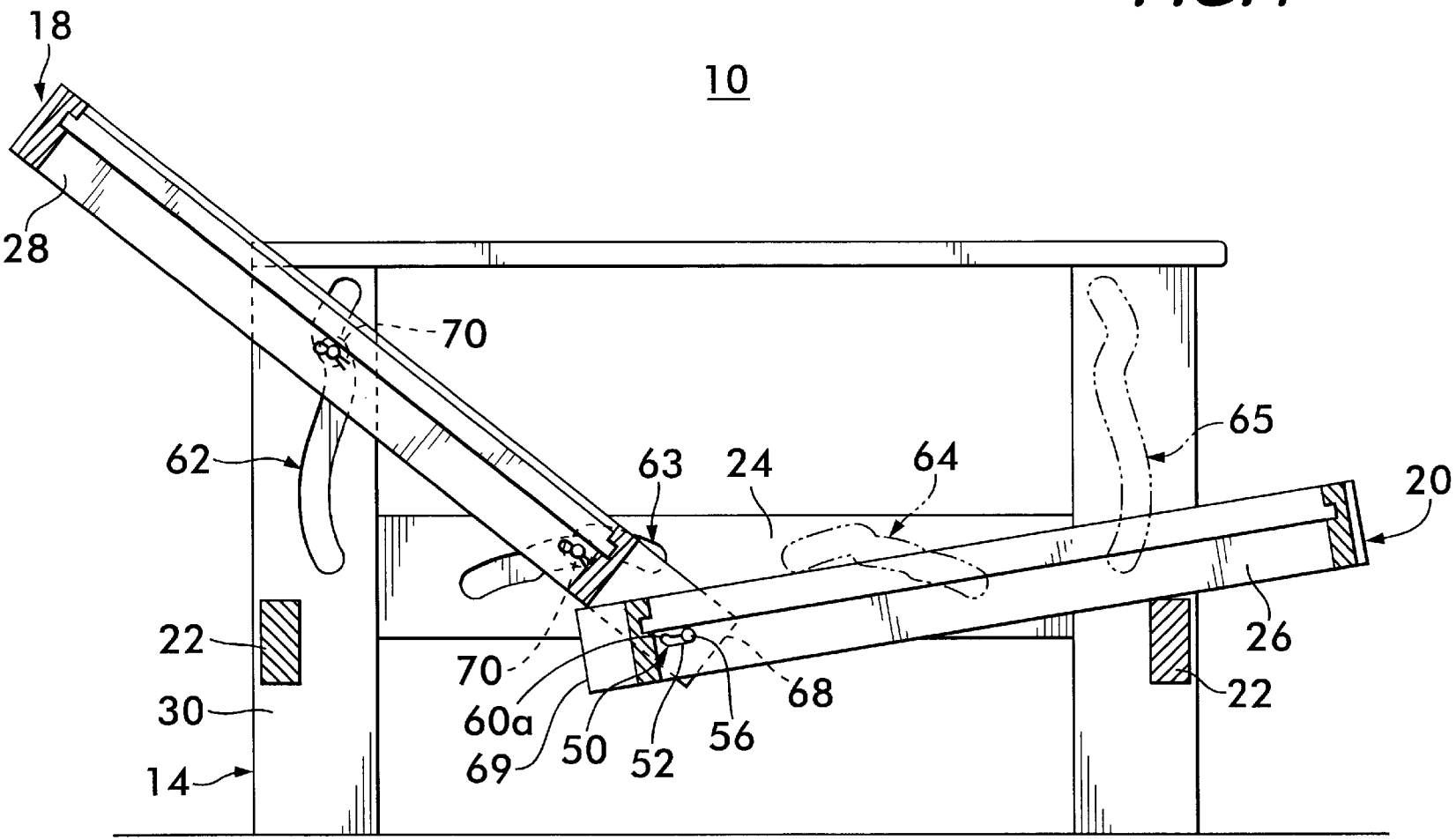
FIG. 4 shows a side view of the convertible furniture frame of the present invention in the least upright or most reclined orientation of the multiple sitting orientations of the invention.
Figure 5:
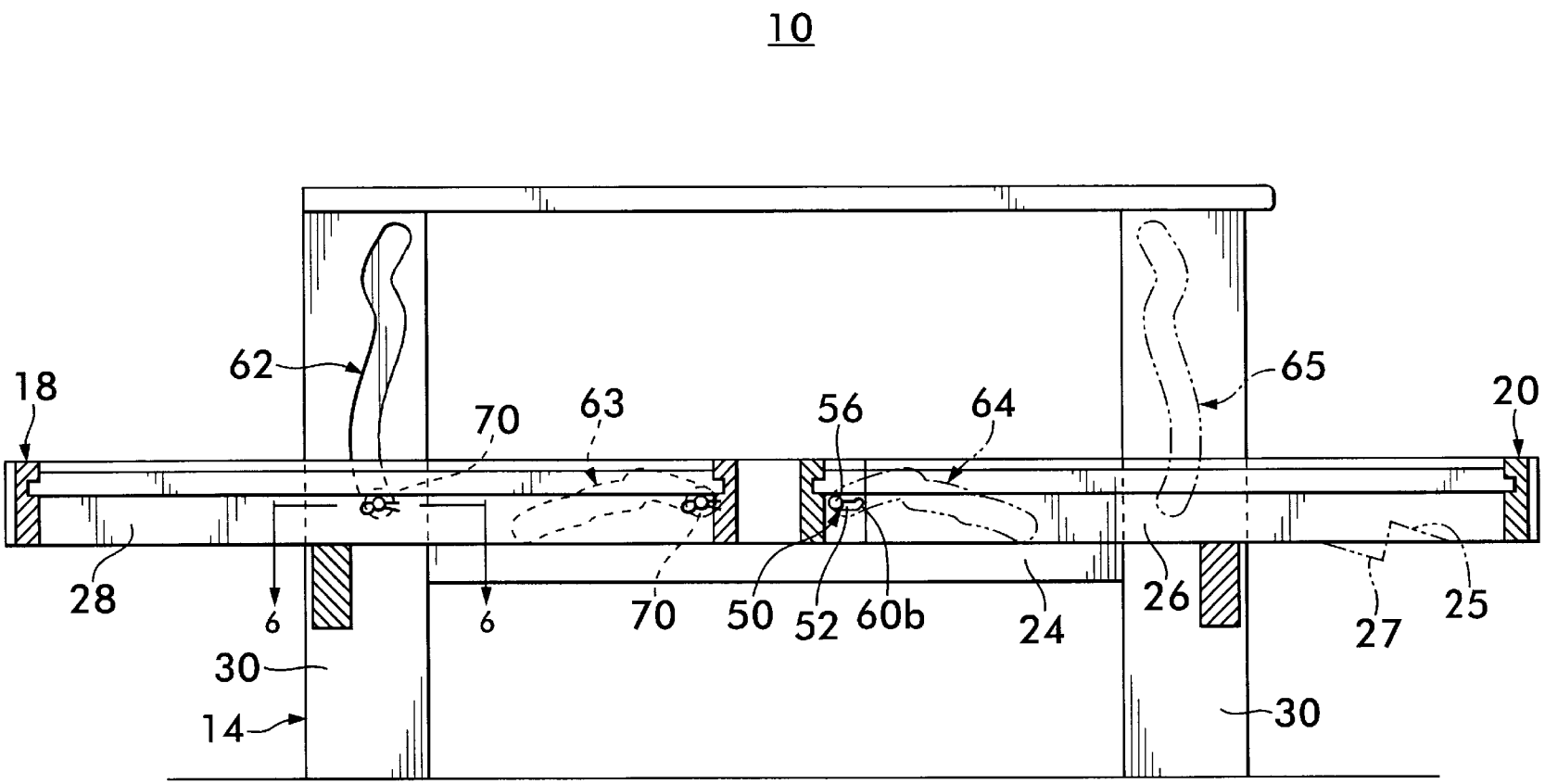
FIG. 5 shows a side view of the convertible furniture frame of the present invention in a bed orientation.

Each pivot connection 50 includes a slot 52 located in spaced apart section side members 26 of the seat frame section 20. In one preferred embodiment of the invention the slots 52 are elongated non-linear slots having an arcuate region at each end thereof. A hinge pin 56 extends outwardly from each of the spaced apart section side members 28 of the back rest frame section 20 and through the non-linear slots 52. The hinge pins 56 are disposed in the non-linear slots 52 at the slot ends 60b when the frame sections 18, 20 are disposed in the sitting orientations as shown in FIGS. 2–4, and through the opposing slot ends 60*a* when the frame sections 18, 20 are disposed in the bed orientation as shown in FIG. 5.

The arcuate configuration of the non-linear slots 52 is preferred in order to assist in preventing the hinge pins 56 from inadvertently traveling along slots 52 away from the slot ends 60*b* when the frame sections 18,20 are disposed in a sitting orientation. If such an inadvertent movement of hinge pins 56 occurs when the frame sections 18, 20 are in the third seating position it could result in a sudden unexpected change in the orientation of the frame sections 18, 20 into the bed orientation. Additionally, the arcuate configuration of the slots 52 assists in maintaining the hinge pins 56 in the slot ends 60*a* when the furniture frame 10 is disposed in the bed orientation. The arcuate region of the slot 52 for preventing such a movement can be in the vicinity of slot end 60*b* of slot 52.

As previously described, the hinge pins 56 reside at the slot ends 60*a* of the non-linear slots 52 when the frame sections 18,20 are in the bed orientation. The arcuate configurations at the slot ends 60*a* are adapted to prevent the hinge pins 56 from inadvertently moving out of the slot ends 60*a* when the frame sections 18, 20 are in the bed orientation. However, it will be understood that in another embodiment, not shown, the convertible furniture frame 10 can include a substantially linear rather than a non-linear elongate slot 52.

Figure 11:
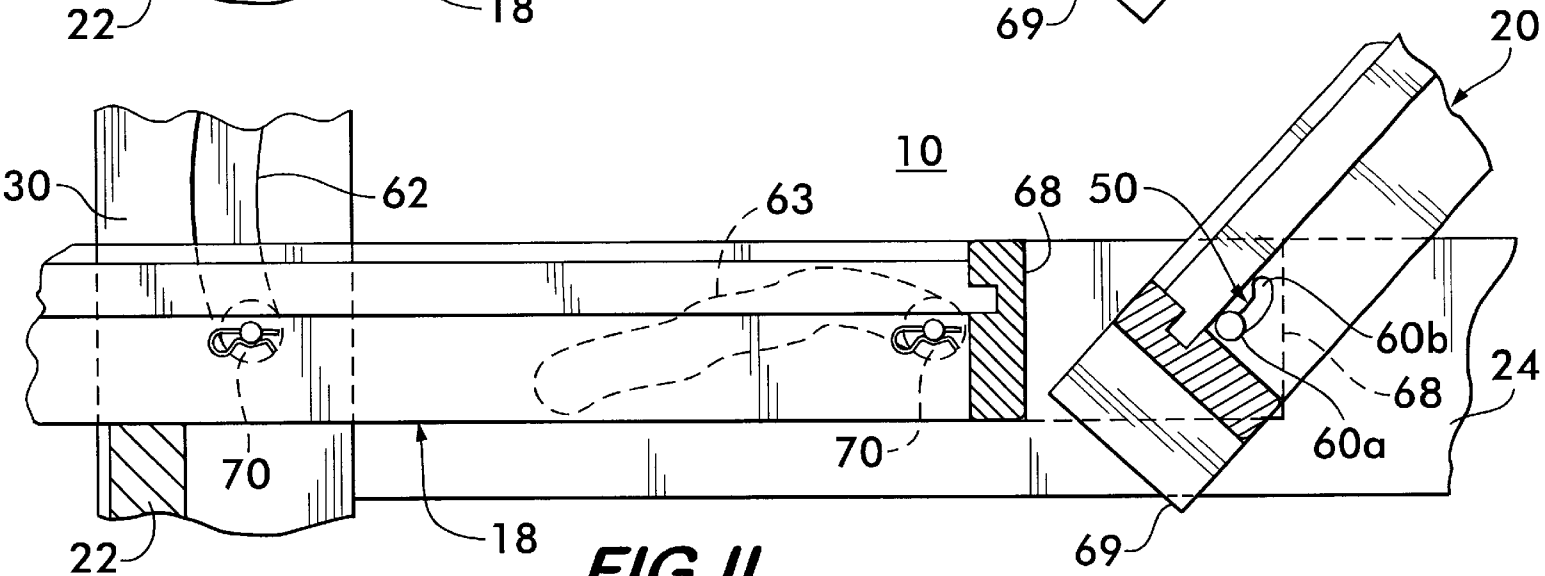
Figure 12:
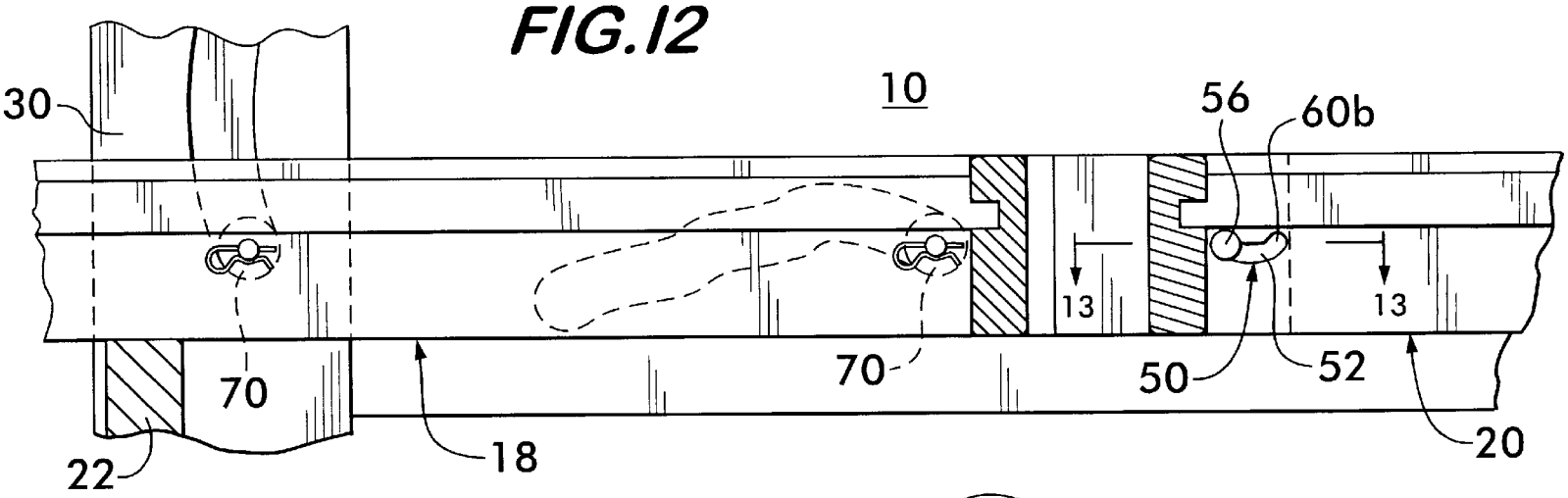
Figure 13:
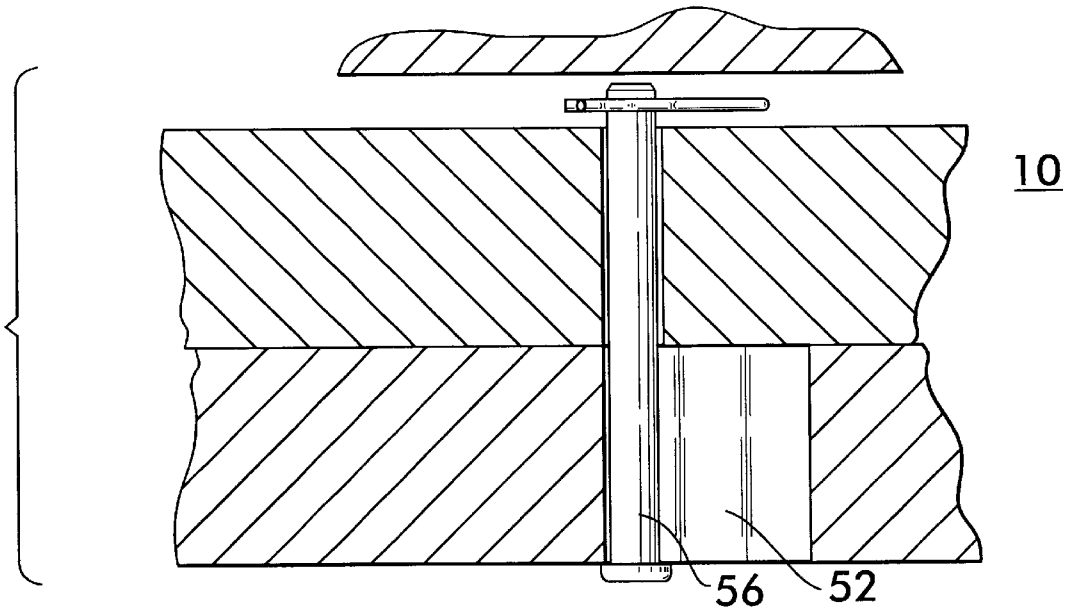
FIG. 13 shows a cross-sectional representation of a hinge portion of the convertible furniture frame of the present invention.

Referring now to FIGS. 8–12, there are shown side views of a portion of the convertible furniture frame 10 as the convertible frame 10 is converted from a sitting orientation (FIG. 8) into a bed orientation (FIG. 12). The seat frame section 20 is moved forward to allow the back rest section 18 to move from the locking location 96 to the locking location 100. When the seat frame section 20 is moved into the locking location 100 it is brought into an interfering relationship with the back rest frame section 18 (FIG. 9). The seat frame section 20 can then used to direct the back rest frame section 18 into its horizontal position (FIG. 10) and pulled in the direction indicated by the arrow 32 in order to eliminate the interfering relationship by causing the hinge pin 56 to move from the slot end 60*b* to the slot end 60*a* (FIG. 11). When the interfering relationship of the frame sections 18,20 is eliminated in this manner the seat frame section 20 is free to rotate into its horizontal position.

Thus, the use of the interfering relationship permits front conversion of the convertible furniture frame 10 into the bed position. In order to create the interfering relationship the frame section 20 of the convertible furniture frame 10 includes a rear seat section 69 in the rear portion thereof. The back rest frame section 18 includes a lower back rest section 68. Thus, the rear seat section 69 is disposed in the vicinity of the lower back rest section 68 of the back rest frame section 18. It is the rear seat section 69 and the lower back rest section 68 that meet with each other in the interfering relationship when the frame sections 18, 20 are pivoted toward the bed orientation.

In an alternate embodiment of the convertible furniture frame 10, interfering sections 68, 69 are not provided. In this embodiment front conversion from a bed to a couch of the convertible furniture frame 10 is not possible and a user must manually rotate each frame section 18, 20 in order to convert into the bed orientation.

Each of the section side members 28 of the back rest frame section 18 is provided with two outwardly extending slot followers 70. This is shown, for example, in FIGS. 7–12. The rear regions of the vertical side sections 30 of the side frame members 14 are each provided with an elongate position locating and retaining slot 62 for receiving and movably retaining one of the two slot followers 70 extending from a section side member 28. The horizontal side sections 24 of the vertical side sections 30 are each provided with a retaining slot 63 for receiving and movably retaining the other slot follower 70 of the section side member 28.

The side frame members 14 are shown with two additional retaining slots 64, 65 in the drawings. The retaining slots 64, 65 are adapted to receive corresponding slot followers 70 at the end of the back rest section 18 opposite the end where retaining slots 62, 63 are used. Each side frame member 14 is thus adapted for use at both ends of the convertible furniture frame 10. However, a preferred embodiment, not shown, differing left and right side frame members 14 can be provided. In the preferred embodiment, one of the separate frame members 14 includes only the retaining slots 62, 63 and the other includes only the retaining slots 64, 65. Thus, the side frame members 14 must be used on the correct ends of the convertible furniture frame 10 in this alternate embodiment.

Figure 14:
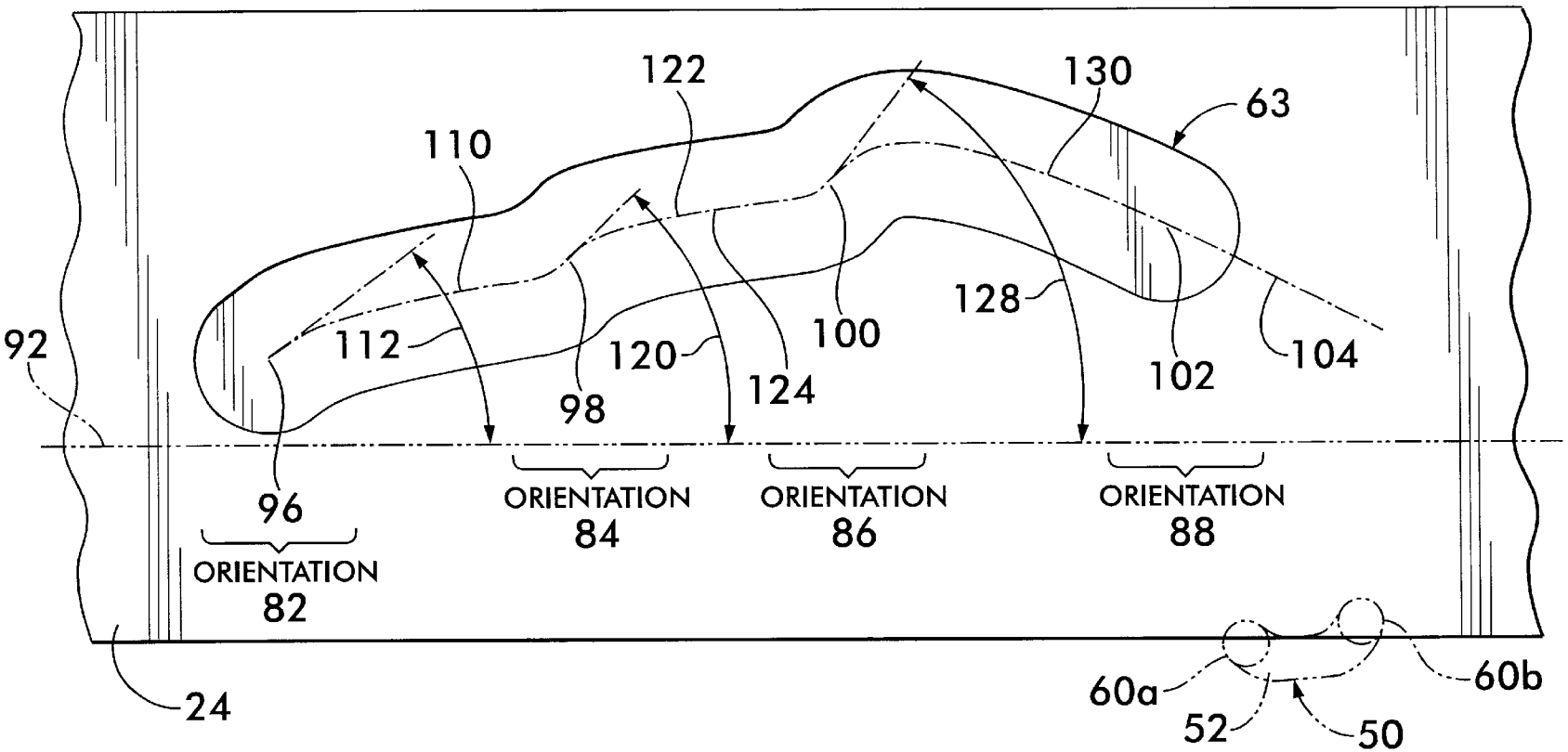
FIG. 14 shows an enlarged representation of a locating and retaining slot of the convertible furniture frame of the present invention showing the multiple locking locations corresponding to the multiple orientations of the invention.

Referring now to FIG. 14, there is shown an enlarged view of a retaining slot 63 for illustrating a plurality of arcs and substantially flat surface segments of the retaining slot 63. The retaining slot 63 is shown with a centered axis 104. The arcs and surface segments of the retaining slot 63 act in cooperation with a slot follower 70 disposed therein to locate and retain the back rest frame section 18 in each of the multiple orientations of the convertible furniture frame 10.

Four slot follower locking locations 96, 98, 100, 102 are shown within the retaining slot 63. The locking locations 96, 98, 100, 102 are the locations within the retaining slot 63 where the slot follower 70 resides when the convertible furniture frame 10 is locked in each of its four orientations in the preferred embodiment of the invention. The locking location 96 can be referred to as the first locking location, the locking location 98 can be referred to as the second locking location, and the locking location 100 can be referred to as the third locking location. Each locking location 96, 98, 100, 102 includes an arcuate region with a flat surface segment therein. The flat surface segments, in combination with an arc within the arcuate region and adjacent the flat surface segment, form a bump in each locking location 96, 98, 100, 102.

Figure 7:
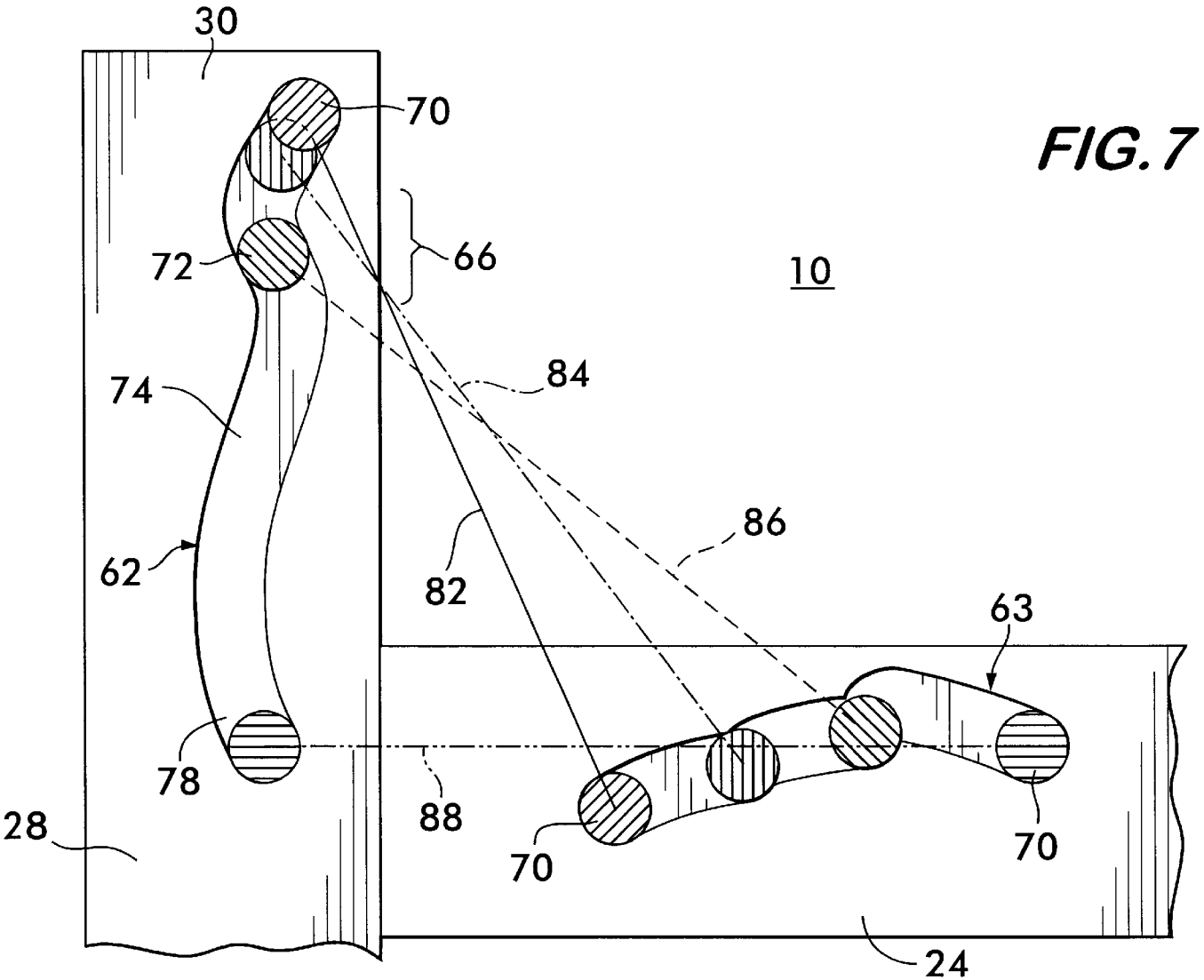
FIG. 7 shows a schematic representation of a plurality of positions of the slot follower within the slots wherein the slot follower positions correspond to the multiple orientations of the convertible furniture frame of the present invention.
Figure 10:
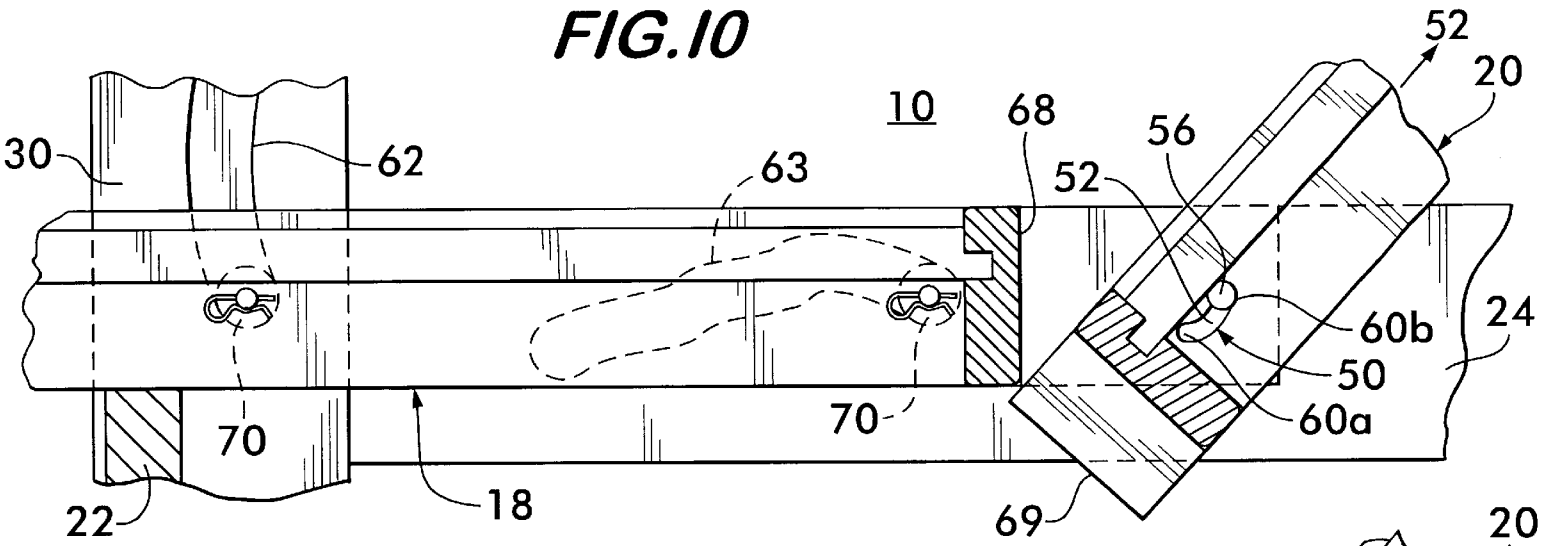
FIGS. 10–12 show side views of the convertible furniture frame of the present invention as the sections of the furniture frame are moved from the least upright orientation into the bed orientation.

The most upright orientation 82 of the convertible furniture frame 10 is represented as a line connecting the two slots followers 70 in FIG. 7. The upright most orientation is orientation 82. The orientations 84, 86 are the second most upright and the least upright or most reclined sitting orientations, respectively, of the convertible furniture frame 10. The orientation 88 is the bed orientation. The four locking locations 96, 98, 100, 102 of the retaining slot 63 correspond to the four orientations 82, 84, 86, 88, respectively. Thus, when the convertible furniture frame 10 is disposed in each of the four orientations 82, 84, 86, 88 the slot follower 70 is disposed at a corresponding one of the four locking locations 96, 98, 100, 102.

In this manner, when the frame sections 18, 20 are disposed in the most reclined orientation 86 the slot follower 70 resides in the locking location 100. When the frame sections 18, 20 are disposed in the locking location 100, it is essential to prevent them from becoming inadvertently unlocked and falling into the locking location 102 which correspondences to the bed orientation 88.

As best seen in FIG. 7, when the convertible furniture frame 10 is disposed in the orientation 86, the slot follower 70 of the retaining slot 62 is disposed in the slot region 66. The slot region 66 includes a support stop 72 for supporting the slot follower 70 when the frame sections 18, 20 are locked in the orientation 86. As the retaining slot 62 extends downwardly within the slot region 66, in the upper half of the slot region 66, it slopes at an angle toward the rear of the side section 30, with the angle of the slope decreasing as the retaining slot 62 approaches the support stop 72. In the region of the support stop 72, the slope of the retaining slot 62 reverses direction. Continuing in the downward direction, below the support stop 72, the retaining slot 62 begins to slope at an angle toward the front of the side section 30. The reversal in the slope direction of the retaining slot 62 in the vicinity of the support stop 72 from the rearward direction to the forward direction creates a non vertical region that forms the support stop 72. The support stop 72 cooperates with the locking location 100 of the retaining slot 63 of the slot region 66 to maintain the frame sections 18, 20 in a locked relationship when the convertible furniture frame 10 is locked in the orientation 86.

The locking location 100 of the retaining slot 63 is optimized for preventing movement from the sitting orientation 86 into the bed orientation 88, in the preferred embodiment of the invention by the selection of the angle 128 of the flat segment within the arcuate region of the locking location 100. Preferably, the angle 128 is equal to approximately fifty-three degrees with respect to the edge 92 of the horizontal side section 24.

If the angle 128 is decreased more than approximately five degrees it can become too easy for the convertible furniture frame 10 to inadvertently pop out of the locking location 100. If the angle 128 is increased by more than five degrees, it can be too difficult to intentionally rotate the furniture frame 10 from the locking location 100. The arcuate region of the locking location 100 is preferably formed of two arcs separated by a flat segment in order to help secure the slot follower 70 within the locking location 100. Thus, the slot follower 70 is required to travel from the flat segment and over the bump between the locking locations 100, 102 in order for the convertible furniture frame 10 to fall from the orientation 86 into the orientation 88.

When the frame sections 18, 20 are locked in the orientation 86 by the locking location 100, the convertible furniture frame 10 can be provided with a frame stop in order to prevent relative motion between the seat frame section 20 and the longitudinal support rail 22. Preventing such relative motion assists in locking the frame sections 18, 20 in the orientation 86.

For example, as shown in FIG. 5, the transverse section side member 26 of the seat frame section 20 can be provided with a downwardly extending frame stop abutment 27 disposed upon the bottom surface of the side member 26. The location of the frame stop abutment 27 along the section side member 26 is selected so as to cause the frame stop abutment 27 to abut the support rail 22 and releasably prevent motion of the section side member 26 with respect to the support rail 22 when the convertible furniture frame 10 is in a selected orientation, for example, the orientation 86. It is well known in the art to form the frame stop abutment 27 as a plastic stopper. The frame stop abutment 27 is preferably triangular in its side view in order to prevent the support rail abutting it when moving in the opposite relative direction.

In an another alternate embodiment, the frame stop can be provided as a frame stop notch 25 in the bottom side of the section side member 26. The frame stop notch 25 releasably receives and mates with the longitudinal support rail 22. The mating of the notch frame stop 25 and the support rail 22 prevents relative movement of section side member 26. Thus, the frame stop notch 25 can assist in maintaining the convertible furniture frame 10 in a selected orientation, for example, the orientation 86. The location of the frame stop notch 25 along the section side member 26 is selected so that the notch 25 mates with the support rail 22 when the convertible furniture frame 10 is in the selected orientation. It will be understood by those skilled in the art that any other type of frame stop can be used provided it can releasably prevent relative motion of the section side member 26 and the longitudinal support rail 22 when the furniture frame 10 is locked in the selected orientation.

The interfering relationship of the frame sections 18, 20, as shown in FIG. 9, can also assist in maintaining the frame sections 18, 20 locked into the orientation 86. As previously described, the rear seat section 69 of the seat frame section 20 is pivotally brought into abutment with the lower back rest section 68 of the back rest frame section 18. The abutting relationship of the sections 68, 69 prevents further pivoting of the frame sections 18, 20 until it is removed by shifting the hinge pin 56 within the slot 52. Since rotation of the frame sections 18, 20 from the orientation 86 to the orientation 88 requires such further pivoting, the rotation is prevented by the interfering relationship. In one preferred embodiment, the convertible furniture frame 10 can include either a frame stop or the interfering relationship of the sections 68, 69 for acting in cooperation with the locking location 100 in order to maintain the furniture frame 10 in the orientation 86.

When a user intends to rotate the convertible furniture frame 10 from the orientation 86 to the bed orientation 88 the front of the seat frame section 20 is rotated upwardly, permitting the back rest frame section 18 to rotate downwardly. The seat frame section is then slidably moved in order to dislodge the hinge pins 56 within the slots 52. Furniture frame 10 can then move into the orientation 88.

When the slot follower 70 leaves the locking location 100 and travels over the surface segment 130 it travels to the locking location 102. Simultaneously, as shown in FIG. 7, the slot follower 70 within the retaining slot 62 passes through the slot region 74 and comes to rest in the bed lock slot region 78. The angle of the bed lock slot region 78 in the vicinity of where the slot follower 70 rests has an angle greater than zero degrees with respect to the vertical as determined by the vertical edge of the member 30. In the preferred embodiment of the invention, the angle can be approximately twenty-seven degrees.

Since the surface segment 130 is steeply inclined in the direction from the locking location 102 to the locking location 100, it is difficult for the frame section 18 to inadvertently pop out of its bed orientation 88 during such use. For example, the surface segment 130 can be inclined at an angle of approximately twenty-five degrees with respect to the edge 92 of the horizontal side of section 24.

In order for the slot follower 70 of the retaining slot 63 to climb segment 130 in the direction from the locking location 102 to the locking location 100, the slot follower 70 in the retaining slot 62 must travel upward and forward. However, the curvature of the bed lock slot region 78 of the retaining slot 62 prevents such an upward and forward movement of the slot follower. In particular, it is the fact that the angle of the retaining slot 62 is greater than zero with respect to the vertical that prevents such a movement. Thus, the bed lock slot region 78 of the retaining slot 62 and the segment 130 of the locking location 102 act cooperatively to maintain the furniture frame 10 in the bed position. It is thus possible to dispose a substantial amount of weight upon the convertible furniture frame 10 in the region where the frame sections 18, 20 meet in the orientation 88 without causing inadvertent unlocking.

In order to convert the convertible furniture frame 10 from the bed orientation 88 to the upright orientation 86 the frame section 20 is pivoted upward far enough to permit hinge pin 56 to travel from the slot end 60*a* to the slot end 60*b*. The pivoting of the frame section in this manner, and the subsequent pivoting of the frame sections 18,20, also cause the slot follower 70 to travel along the surface segment 130 from the locking location 102 toward the locking location 100.

When the frame sections 18, 20 are disposed in the orientation 84, the slot follower 70 resides in the locking location 98. The flat surface segment of the locking location 98, in combination with the arc adjacent thereto, forms a bump for maintaining the frame sections 18, 20 in a locked relationship. The bump of the locking location 98 can also be any type of discontinuity in the surface of the retaining slot 63. For example, a depression or notch or recess in the flat surface of the retaining slot 63 in the vicinity of the area 124 through which the segment 122 passes can be formed. Such a formation in the surface of the retaining slot 63 can act as a bump for locking the follower 70 in the locking location 98. The formation can be bowl shaped and can have a flat bottom.

In the preferred embodiment, the angle 120 of the flat surface segment of the locking location 98 can be approximately forty-four degrees with respect to the edge 92 in order to lock the convertible furniture frame 10 into the orientation 84. If an angle 120 less than thirty-nine degrees is used, the convertible furniture frame 10 may not remain locked in the orientation 84 during normal conditions of use. If an angle 120 greater than forty-eight degrees is used, it may be difficult to pivot the convertible furniture frame 10 out of the orientation 84 and into the orientation 86.

A frame stop can be provided in order to maintain the furniture frame 10 in the orientation 84 by preventing relative motion between the transverse section side member 26 and the longitudinal support rail 22 as previously described with respect to the orientation 86. The frame stop can be an extending frame stop abutment 27 or a frame stop notch 25 or any other type of frame stop. In the preferred embodiment of the convertible furniture frame 10, a frame stop can be provided for orientation 86 rather than for orientation 84. However, a frame stop can be provided for none or any of the sitting orientations 82, 84, 86 of the convertible furniture frame 10.

When the frame sections 18, 20 are disposed in the orientation 82, the slot follower 70 resides in the locking location 96. In the locking location 96, the slot follower 70 is maintained in its locked condition by the bump formed by the flat surface segment therein and the adjacent arc leading to segment 110.

The straight section 112 of the arcuate region within the locking location 96 can have an angle of approximately thirty-seven degrees with respect to the edge 92 of the horizontal side section 24 in order to lock the convertible furniture frame 10 in the orientation 82. If an angle less than thirty-two degrees is used for the angle of the locking location 96, the convertible furniture frame 10 may not remain locked in the orientation 82. If an angle greater than forty-two degrees is used it may be difficult to move to the next orientation 84.

The retaining slots 62, 64, 65, not shown in FIG. 14, can also include arcs and surface segments as illustrated with respect to the retaining slot 63. The further arcs and surface segments of the retaining slots 62, 64, 65 can also define the multiple locking locations 96, 98, 100, 102 and orientations 82, 84, 86, 88 by acting in cooperation with the slot followers 70 therein. Furthermore, the surface segments of the locking locations 96, 98, 100, 102 within the retaining slots 62, 64, 65 are also adapted to assist in locking the frame sections 18,20 into the multiple orientations to thereby prevent inadvertent changes in orientation either with or without frame stops and the interfering relationship of the frame sections 18, 20. Furthermore, the retaining slots 62, 64, 65 act in cooperation with the non-linear slots 52 and the hinge pins 56 as previously described.

Without further elaboration, the foregoing will so fully illustrate the invention that others may, by applying current or future knowledge, adapt the same for use under various conditions of service.

We claim:

1. A furniture frame convertible from a seat to a bed, said furniture frame including side frame members spaced-apart by a supporting rail and a body-supporting member including two sections pivotally connected together and being connected to said side frame members substantially toward the rear of said furniture frame, comprising;

said two sections being movable relative to each other between at least first and second sitting orientations and a bed orientation wherein said first sitting orientation is less upright than said second sitting orientation;

said two sections providing a seat section and a back section having transversely spaced apart side section members and upper surfaces inclined relative to each other when said two sections are in one of said first and second sitting orientations, and said upper surfaces of said two sections being aligned in substantially the same horizontal plane when said two sections are in said bed orientation;

a pivot connection between said two sections for permitting relative rotational motion of said two sections between said at least first and second sitting orientations and said bed orientation;

said side section members of said back section including transversely extending followers and each of said side frame members including a pair of elongate position-locating and retaining slots, one of said followers on said side section members of said back section being disposed within one slot of said pair of retaining slots, and the other of said followers on said side section members of said back section being disposed within the other slot of said pair of retaining slots, said followers being movable within said retaining slots as said seat and back sections move between said at least first and second sitting orientations and said bed orientation;

said retaining slots having a first locking location for disposing said two sections in said first sitting orientation and locking said two sections in said first sitting orientation;

said retaining slots having a second locking location for disposing said two sections in said second sitting orientation and locking said two sections in said second sitting orientation; and said first locking location having a first bump for retaining one of said followers within said first locking location.

2. The furniture frame of claim 1, wherein said first bump comprises a first flat segment.

3. The furniture frame of claim 2, wherein said first bump comprises an arc joined to said first flat segment at an end of said first flat segment.

4. The furniture frame of claim 1, wherein said first bump comprises a discontinuity in the surface of said retaining slots.

5. The furniture frame of claim 2, wherein said first flat segment supports said one of said followers when said two frame sections are disposed in said first sitting orientation.

6. The furniture frame of claim 5, wherein said second locking location comprises a second bump.

7. The furniture frame of claim 6, wherein said second bump comprises a first flat segment joined to an arc at an end of said second flat segment.

8. The furniture frame of claim 1, further comprising a third sitting orientation for disposing said two sections in said third sitting location, wherein said third sitting orientation is less upright than said first sitting orientation.

9. The furniture frame of claim 8, comprising a further locking location for locking said two sections in said third sitting orientation.

10. The furniture frame of claim 8, further comprising a section stop for preventing relative motion between said supporting rail and said seat section.

11. The furniture frame of claim 10, wherein said section stop comprises a notch formed in said seat section for mating with said supporting rail to prevent said relative motion between said supporting rail and said seat section.

12. The furniture frame of claim 10, wherein said section stop comprises an abutment extending downwardly from said seat section for abutting said supporting rail to prevent said relative motion between said supporting rail and said seat section.

13. The furniture frame of claim 9, wherein said retaining slots include a horizontal retaining slot and a vertical retaining slot on each of said side frame members, said horizontal retaining slots including said first, second and third locking locations and said vertical retaining slots having a support stop therein for supporting one of said slot followers when said two sections are disposed in said third sitting orientation.

14. The furniture frame of claim 13, wherein said vertical retaining slots further comprise a vertical slot region, said vertical slot region including said support stop, wherein said vertical slot region slopes downwardly and rearwardly as it approaches said support stop and downwardly and forwardly as it extends below said support stop thereby forming said support stop.

15. The furniture frame of claim 14, wherein said support stop comprises a substantially flat surface.

16. The furniture frame of claim 15, wherein said support stop acts cooperatively with said first locking location to maintain said two sections in said third sitting orientation.

17. The furniture frame of claim 8, wherein said two sections are pivotally disposed in an interfering relationship with each other whereby further pivoting of said two sections is prevented.

18. The furniture frame of claim 17, wherein a bottom portion of said back section and a rear portion of said seat section are disposed in said interfering relationship with each other.

19. The furniture frame of claim 17, wherein said retaining slots include horizontal retaining slots and vertical retaining slots on each of said side frame members, said horizontal retaining slots including said first and second locking locations and said vertical retaining slots having a support stop for supporting one of said slot followers when said two sections are disposed in said third sitting orientation.

20. The furniture frame of claim 17, wherein said pivot connection comprises elongate slots located in said side section members of said seat section.

21. The furniture frame of claim 20, further comprising a hinge pin extending from said side section members of said back section and extending through said elongate slots.

22. The furniture frame of claim 21, wherein said elongate slots are configured to preclude movement of said hinge pins from one end of said elongate slots to the other end of said elongate slots when said two sections are in a sitting orientation of said first, second, and third sitting orientations and to preclude movement of said hinge pins from said other end of said elongate slots to said one end of said elongate slots when said two sections are in said bed orientation.

23. The furniture frame of claim 17, wherein said retaining slots have a third locking location for disposing said two sections in said third sitting orientation and locking said two sections in said third sitting orientation.

24. The furniture frame of claim 23, wherein said third locking location has a third bump therein for retaining said follower within said third locking location.

25. The furniture frame of claim 24, wherein said third bump comprises a third flat segment joined to an arc at an end of said third flat segment.

26. The furniture frame of claim 23, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in said third sitting orientation.

27. The furniture frame of claim 8, wherein said retaining slots have a third locking location for disposing said two sections in said third sitting orientation and locking said two sections in said third sitting orientation.

28. The furniture frame of claim 27, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in said third sitting orientation.

29. The furniture frame of claim 27, further comprising a section stop for preventing relative motion between said supporting rail and said seat section.

30. The furniture frame of claim 29, wherein said section stop comprises a notch formed in said seat section for mating with said supporting rail to prevent said relative motion between said supporting rail and said seat section.

31. The furniture frame of claim 29, wherein said section stop comprises an abutment extending downwardly from said seat section for abutting said supporting rail.

32. The furniture frame of claim 29, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in said third sitting orientation.

33. The furniture frame of claim 1, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in a third sitting orientation.

34. The furniture frame of claim 1, wherein said two sections are pivotally disposed in an interfering relationship with each other whereby further pivoting of said two sections is prevented.

35. The furniture frame of claim 34, wherein a bottom portion of said back section and a rear portion of said seat section move into said interfering relationship.

36. The furniture frame of claim 35, wherein said pivot connection comprises elongate slots disposed in said side section members of said seat section.

37. The furniture frame of claim 36, further comprising a hinge pin extending from said side section members of said back section and extending through said elongate slots.

38. The furniture frame of claim 37, wherein said elongate slots are configured to preclude movement of said hinge pins from one end of said elongate slots to the other end of said elongate slots when said two sections are in a sitting orientation of said first, second, and a third sitting orientations and to preclude movement of said hinge pins from said other end of said elongate slots to said one end of said elongate slots when said two sections are in said bed orientation.

39. The furniture frame of claim 34, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in said third sitting orientation.

40. The furniture frame of claim 1, further comprising a section stop for preventing relative motion between said supporting rail and said seat section.

41. The furniture frame of claim 40, wherein said section stop comprises a notch formed in said seat section for mating with said supporting rail to prevent said relative motion between said supporting rail and said seat section.

42. The furniture frame of claim 40, wherein said section stop comprises an abutment extending downwardly from said seat section for abutting said supporting rail.

43. The furniture frame of claim 40, wherein said retaining slots include horizontal retaining slots and vertical retaining slots on each of said side frame members, said horizontal retaining slots including said first and second locking locations and said vertical retaining slots having a support stop therein for supporting one of said slot followers when said two sections are disposed in a third sitting orientation.

44. The furniture frame of claim 1, wherein a first locking location angle is between thirty-nine degrees and forty-nine degrees.

45. The furniture frame of claim 44, wherein said first locking location angle is approximately forty-four degrees.

46. The furniture frame of claim 45, wherein a second locking location angle is approximately between thirty-two and forty-two degrees.

47. The furniture frame of claim 46, wherein said second locking location angle is approximately thirty-seven degrees.

48. The furniture frame of claim 8, wherein a third locking location angle is between approximately forty-eight degrees and fifty-eight degrees.

49. The furniture frame of claim 48, wherein said third locking location angle is approximately fifty-three degrees.

50. A furniture frame convertible from a seat to a bed, said furniture frame including side frame members spaced-apart by a supporting rail and a body-supporting member including two sections pivotally connected together and being connected to said side frame members, comprising;

said two sections being movable relative to each other between at least first, second, and third sitting orientations and a bed orientation wherein said first sitting orientation is more upright than said second setting orientation;

said two sections providing a seat section and a back section, respectively, having transversely spaced apart side section members and upper surfaces inclined relative to each other when the two sections are in one of said first and second sitting orientations, and said upper surfaces of said two sections being aligned in substantially the same horizontal plane when said two sections are in the bed orientation;

a pivot connection between said two sections for permitting relative rotational motion of said two sections between said at least first and second sitting orientations and said bed orientation;

said side section members of said back section including transversely extending followers and each of said side frame members including a pair of elongate position-locating and retaining slots, one of said followers on said side section members of said back section being disposed within one slot of said pair of retaining slots, and the other of said side section members of said back section being disposed within the other slot of said pair of retaining slots, said followers being movable within said retaining slots as said seat and back sections move from said at least first and second sitting orientations and said bed orientation;

said retaining slots having a first locking location for disposing said two sections in said first sitting orientation and locking said two sections in said first sitting orientation;

said retaining slots having a second locking location for disposing said two sections in said bed orientation and locking said two sections in said bed orientation;

said first locking location having a bump therein for retaining said follower within said first locking location; and wherein said retaining slot comprises a third locking location for disposing said two sections in said third sitting orientation and locking said two sections in said third sitting orientation wherein said third sitting orientation is more upright than said first sitting orientation.

51. A furniture frame convertible from a seat to a bed, said furniture frame including transversely spaced-apart side frame members and a body-supporting member including two sections pivotally connected together and being connected to said side frame members, comprising;

said two sections being movable relative to each other between at least one sitting orientation and a bed orientation, said two sections providing a seat and back section, respectively, having upper surfaces inclined relative to each other when the two sections are in a sitting orientation, and said upper surfaces of said two sections being aligned in substantially the same horizontal plane when said two sections are in the bed orientation;

each of said two sections having transversely spaced-apart side section members, with each of the side section members of one of said two sections overlapping and being closely adjacent to a side frame member of the other of said two sections in a region adjacent a rear of the seat section and a bottom of the back section, a pivot connection between said overlapping sections at the rear of the seat section and the bottom of the back section for permitting relative rotational motion of said two sections between said at least one sitting orientation and said bed orientation, said pivot connection including an elongate slot in each of the spaced-apart frame members of one of said two sections and a hinge pin connected to each of the spaced-apart frame members of the other of said two sections;

each of said hinge pins being disposed within one of said slots at one end thereof when said two sections are in the sitting orientation and at the other end of said slot when said two sections are in the bed orientation; and said slot being configured to preclude said hinge pin from moving from said one end of said slot to the other end of said slot when said two sections are in a sitting orientation and from moving from the other end of said slot to said one end of said slot when the two sections are in the bed orientation, whereby movement of the two sections from the sitting orientation to the bed orientation can be accomplished by manually pivoting the two sections in a first direction relative to each other out of the sitting orientation and into a position in which each of the hinge pins can be slid within its slot to the other end of said slot, moving the two sections relative to each other to shift each hinge pin to the other end of its slot, and then pivoting the two sections in a second direction opposed to said first direction to move said two sections into the bed orientation, and whereby movement of the two sections from the bed orientation to the sitting orientation can be accomplished by manually pivoting the two sections in said first direction relative to each other out of the bed orientation and into an orientation in which each of the hinge pins can be slid within its slot to the one end of said slot, moving the two sections relative to each other to shift each hinge pin to the one end of its slot so that the two sections can assume a sitting orientation.

52. The furniture frame of claim 51, further comprising two pivot connections, each of said two pivot connections including a non-linear elongate slot in one of said spaced-apart frame members of said one of said two sections and a hinge pin connected to said spaced apart frame member of said other of said two sections, wherein each of said hinge pins is disposed in one of said non-linear slots and each of said non-linear slots is configured to preclude said hinge pin disposed therein from moving from one end thereof to the other end thereof.

53. The furniture frame of claim 52, wherein said pivoting of said two sections relative to each other in said first direction causes each of said hinge pins to slide within its non-linear slot.

54. The furniture frame of claim 51, wherein the seat section includes a rear frame section underlying a lower frame section of the back section when the seat and back sections are in a sitting orientation with the hinge pins at said one end of said non-linear slots, said rear frame section interfering with said lower frame section to preclude the seat section and the back section from being pivoted from a sitting orientation into the bed orientation.

55. The furniture frame of claim 52, wherein said rear frame section of the seat is moved out of interfering relationship with the lower frame section of the back section when the hinge pins are disposed in the other end of said non-linear slots to permit the seat and back sections to be pivoted into the bed orientation.

56. The furniture frame of claim 55, wherein said two sections are movable into multiple sitting orientations, said lower frame section of said back section engaging the rear frame section of the seat section in a most reclined sitting orientation.

57. The furniture frame of claim 51, wherein each of said side frame members of said back section includes two transversely extending followers and each of the transversely spaced-apart side frame members includes a pair of elongate, position-locating and retaining slots, with the followers on the side frame members of the back section being disposed within each of the said pair of slots, said followers being movable within said slots as said seat and back sections move from said at least one sitting orientation to said bed orientation.

58. The furniture frame of claim 57, wherein transversely extending followers of the back section are each moved over a curved slot segment and into a distal end of a corresponding one of said other of said pair of slots when the seat and back sections are moved into said bed orientation, said curved slot segment of each of said other of said pair of slots partially overlying one of said transversely extending followers of the back section to preclude upward movement of the back section out of said bed orientation when said hinge pin is in said other end of said non-linear slot, whereby said seat and back sections are precluded from collapsing about said hinge pin out of the bed orientation when a downward force is imposed on either said seat or back section.

59. The furniture frame of claim 58, wherein said seat and back sections are moveable into multiple sitting orientations, said slots in said side frame members cooperating with the followers on the back sections to define the position of the seat and back sections in each of the sitting orientations, at least one of the slots in each pair of slots including surface segments cooperating with followers therein for assisting in retaining the seat and back sections in each of the multiple sitting orientations.

60. The furniture frame of claim 59, wherein said surface segments are included in the slots that receive the followers extending from the back section therein, said surface segments being upwardly inclined, substantially linear segments disposed intermediate the opposed ends of the slots.

61. The furniture frame of claim 59, wherein said seat and back sections are moveable into three sitting orientations and a bed orientation.

62. The furniture frame of claim 56, wherein each of the side frame members of the back section includes a transversely extending follower and each of the transversely spaced-apart side frame members includes a pair of elongate, position-locating and retaining slots, and the followers on the side frame members of the back section being disposed within each of said pair of slots, said followers being movable within said slots as said seat and back sections move into different sitting orientations and into said bed orientation.

63. The furniture frame of claim 62, wherein transversely extending followers of the back section are each moved over a curved slot segment and into a distal end of a corresponding one of said other of said pair of slots when the seat and back sections are moved into said bed orientation, said curved slot segment of each of said other of said pair of slots partially overlying one of said transversely extending followers of the back section to preclude upward movement of the back section out of said bed orientation when said hinge pin is in said other end of said non-linear slot, whereby said seat and back sections are precluded from collapsing about said hinge pin out of the bed orientation when a downward force is imposed on either said seat or back section.

64. The furniture frame of claim 63, wherein said slots in said side frame members cooperate with the followers on the back section to define the position of the seat and back sections in each of the sitting orientations, at least one of the slots in each pair of slots including surface segments cooperating with followers therein for assisting in retaining the seat and back sections in each of the multiple sitting orientations, each of said followers on said back section, when said seat and back section are in the most upright sitting orientation, engaging a force transmitting surface of a corresponding slot that imposes an upward force on said each of said followers on said back section to aid in distributing downward forces imposed on the back section that otherwise would be imposed solely on the rear frame section of the seat section by the overlying lower frame section of the back section.

65. The furniture frame of claim 64, wherein said surface segments are included in the slots that receive the followers extending from the seat section therein, said surface segments being upwardly inclined, substantially linear segments disposed intermediate opposed ends of the slots that receive the followers extending from the seat section.

66. The furniture frame of claim 65, wherein said seat and back sections are moveable into three sitting orientations and a bed orientation.

* * * * *